US006310638B1

(12) United States Patent
Heiles et al.

(10) Patent No.: US 6,310,638 B1
(45) Date of Patent: Oct. 30, 2001

(54) CARRIAGE BEARING PRELOADER AND ANTIROTATION RESTORING FORCE FOR REDUCING CARRIAGE VIBRATION

(75) Inventors: Tod S. Heiles, Vancouver, WA (US); James M. Cameron, Los Altos, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/240,099

(22) Filed: Jan. 29, 1999

(51) Int. Cl.[7] ..... B41J 23/00; B41J 2/145; B41J 25/24

(52) U.S. Cl. ..... 347/37; 347/41; 400/352; 400/354

(58) Field of Search ..... 347/37, 86, 87, 347/108, 19, 9, 14, 23, 12, 101, 41; 400/283, 337, 338, 354

(56) References Cited

U.S. PATENT DOCUMENTS 4,744,686 * 5/1988 Wakabayashi ..... 400/352

4,772,899 * 9/1988 Mamiya et al. ..... 347/37

FOREIGN PATENT DOCUMENTS 358 128 887 A * 1/1982 (JP) ..... 400/337

* cited by examiner

*Primary Examiner*—John Barlow
*Assistant Examiner*—Charles W. Stewart, Jr.

(57) ABSTRACT

A carriage, driven along a carriage rod, rests on the carriage rod at carriage V-bearings. The V-bearing connection is open at the bottom. A magnetic preloader applies a magnetic force biasing the carriage toward the carriage rod. A roller coupled to the carriage runs along a track surface away from the carriage rod. At high slew velocities, a local discontinuity, such as a bump, encountered by the roller causes an acceleration of the roller away from the track surface. The upward rotation causes a torque rotating the carriage around the carriage rod. A magnetic restoring torque is applied in the vicinity of the roller to keep the roller running smoothly along the track surface.

18 Claims, 5 Drawing Sheets

FIG. 1
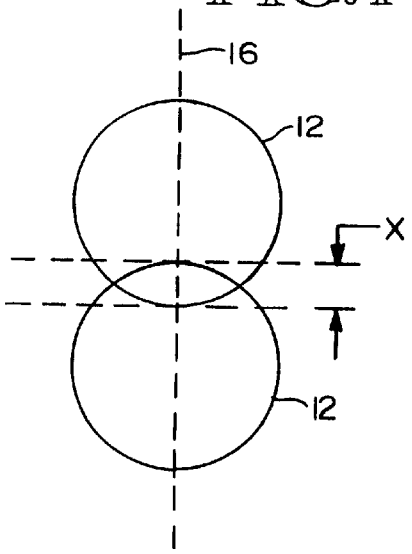
FIG. 2
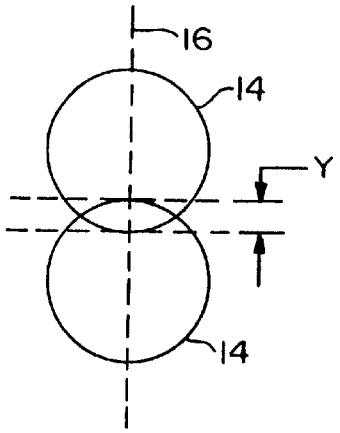
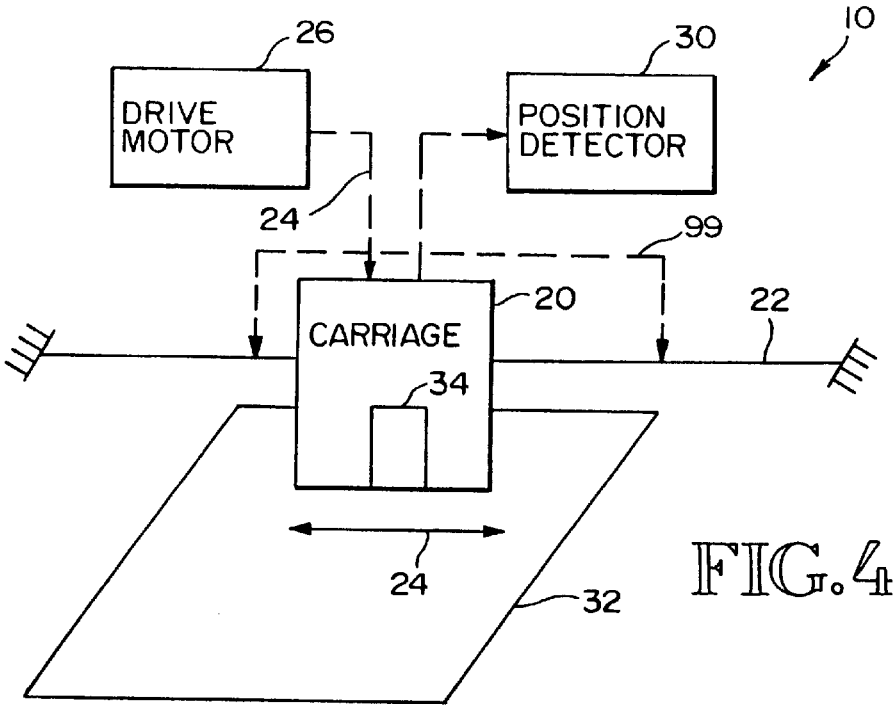
FIG. 4

FIG. 8
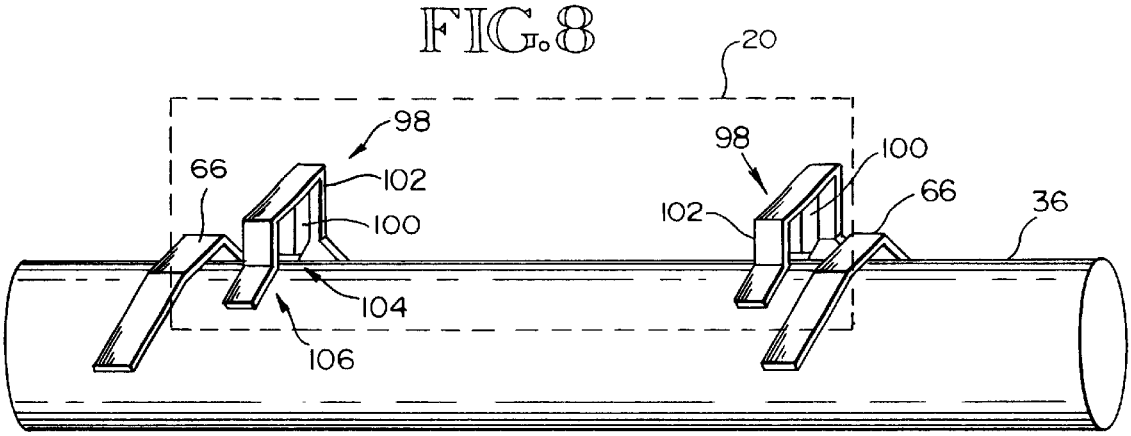
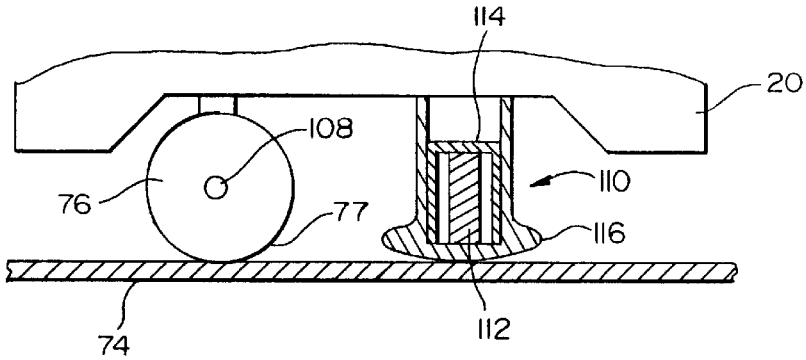
FIG. 9

CARRIAGE BEARING PRELOADER AND ANTIROTATION RESTORING FORCE FOR REDUCING CARRIAGE VIBRATION

BACKGROUND OF THE INVENTION

This invention relates generally to carriage drive systems for printing and scanning devices, and more particularly, to an apparatus and method for reducing vibrations of a carriage during movement along a carriage path.

In inkjet printing systems and document scanning systems a carriage is moved relative to a media to either print or scan the media. In an inkjet printing system, the carriage carries an inkjet pen which ejects ink drops onto the media as the media is moved along a media path. In a document scanning system the carriage carries an optical sensor which detects ink markings or characters on the media as the carriage moves relative to the media. To achieve accurate printing or scanning, it is important to know or maintain an accurate positional relationship between the carriage and the media.

In inkjet printing it is important that the carriage scan the inkjet pen smoothly across the media with minimum vibration so that ink dots can be accurately placed. Conventional inkjet printers print 300 dots per inch or 600 dots per inch. In addition, printers which print at 1200 dots per inch are being sought. As the number of dots per inch increase, the dot size has decreased. Precise dot positioning of the smaller dots at increasing dot density leads to higher quality images. In particular, such positioning of colored dots is leading to near photographic image quality. One challenge in striving to achieve such improved image quality is the adverse impact of carriage vibrations. Dot placement errors as small as 5 microns cause noticeable defects in print quality. FIG. 1 shows two overlapping circles 12 having a common first size. Each circle 12 represents an inkjet printing dot of a first size. Such size is largely exaggerated here for purposes of illustration. FIG. 2 shows two overlapping circles 14 having a common second size which is smaller than the first size. Again, each circle 14 represents an inkjet printing dot of a second size, and such size is largely exaggerated for purposes of illustration. In each example, the dots 12 and dots 14 overlap by a common percentage of their respective diameters (e.g., 20%). The absolute distance of overlap is larger for the larger dots 12 than for the dots 14. The overlap of dots 12 is a distance x. The overlap of dots 14 is a distance y. For purposes of illustration, assume that dots 14 are half the size of dots 12 and that y=0.5x.

Consider now a situation where the carriage vibrates during printing along an axis 16. If the vibration amplitude along axis 16 is much smaller than the distance x, then the impacts of the vibration will not adversely impact the dot placement accuracy, and thus not adversely image the image quality. As the vibration amplitude along axis 16 approaches the distance x, however, more white space occurs on the media in the vicinity of the dots 12 intersection. Taken over an entire image, the effect appears as a banding of lighter and darker areas of the image. FIG. 3 shows an exemplary image 18 exhibiting such banding.

Given the same amount of vibration amplitude, the impact to an image formed of the smaller dots 14 is more adverse than to an image formed with the dots 12. For example, a vibration amplitude of 0.25x may be acceptable for printing using dots 12. The same vibration amplitude equals 0.5y and may cause unacceptable banding when printing with the dots 14. Such bands occur within an image at the frequency of vibration of the carriage along the axis 16. In general, the smaller dot size and higher resolution of advancing ink jet printers require more accurate placement of dots to achieve expected image quality improvements.

Any vibrations displacing the carriage relative to the media can potentially reduce printing/scanning accuracy. Typical sources of vibration are external vibrations which move the whole printer or scanner, and internal sources which are coupled to the carriage or media. This invention is directed toward internal vibrations which are coupled to the carriage. Efforts to reduce the impact of the vibrations have included reducing the magnitude of the vibrations generated by the drive system. This is achieved, for example, by using a smoother running carriage motor or by achieving more accurate meshing of teeth between drive belt and motor. Another approach is to stiffen the carriage system (i.e., increase the resonant frequency of the carriage and carriage rod so that the vibrations have less impact on the carriage). This is achieved, for example, by increasing precision of the carriage bearing, increasing the size of the carriage, or increasing diameter of the carriage rod. All of these solutions add significant expense to the system. Accordingly, there is need for a relatively low cost, yet effective solution for eliminating or reducing the carriage vibrations or the impact of such vibrations.

SUMMARY OF THE INVENTION

A carriage drive system includes a carriage driven along a carriage rod under a force generated by a drive motor through a drive belt. The carriage includes a roller or a sled which runs along a track. Thus, the carriage includes three regions of external contact: the carriage to drive belt connection, the carriage to carriage rod connection, and the carriage to track connection. It is desired that the carriage move along the carriage rod without rotational vibration about the carriage rod, without vibrational offset perpendicular to the carriage rod, and without back and forth vibration along the carriage rod. This invention is directed toward isolating the carriage from rotational vibrations introduced to the carriage through a carriage rod or carriage track.

With regard to the carriage rod, the carriage rest on the carriage rod at carriage V-bearings. The V-bearing connection is open at the bottom. One advantage of such carriage placement is that the carriage does not encounter the entire surface of the carriage rod. This allows the carriage rod to be mounted to a housing at intermittent points along the underside portion of the carriage rod away from the carriage. (Rather than having the rod mounted to the housing at only the end points of the rod). Such mounting of the carriage rod increases stiffness of the carriage rod. In addition the distance between the carriage rod and print media is more uniform over the length of the rod.

According to an aspect of this invention, a magnetic preloader is used to apply a magnetic force biasing the carriage toward the carriage rod. Such magnetic preloader is located in the vicinity of the carriage V-bearings. Preloading the V-bearing connection between the carriage and the carriage rod reduces vibrations from (i) stiff members attached to the carriage such as ink supply tubes; (ii) high acceleration rates of the carriage relative to the carriage rod; (iii) vibrational chatter of the V-bearings along the carriage rod; and (iv) dynamics between the carriage drive motor attachment point, the carriage center of gravity and the carriage center of friction.

According to another aspect of the invention, at the carriage to track connection a restoring force is applied to bias the carriage toward the carriage track. At high slew velocities of the carriage, a local discontinuity, such as a bump, encountered by a carriage roller causes an acceleration of the roller away from the track surface. The magnitude of the acceleration is proportional to the effective slope of the discontinuity multiplied by the carriage slew velocity. The effective slope is the slope of the discontinuity on the roller's surface. The upward rotation causes a torque rotating the carriage around the carriage rod. Such torque is proportional to the moment of inertia times the acceleration at the roller. Gravity causes a restoring torque opposing this rotational torque. The gravitational restoring force is proportional to gravity times the distance from the carriage rod center of gravity to the carriage rod.

According to an aspect of this invention, an additional restoring torque is applied at the roller to keep the roller running smoothly along the track surface. When a bump is encountered, upward displacement at the roller depends on the acceleration (e.g. the effective slope at the bump), the duration of the acceleration (e.g., the height of the bump), the rotational inertia of the carriage, the restoring force attributable to gravity, and any additional restoring forces. According to a preferred embodiment a magnetic restoring force is applied minimizing the upward rotation of the roller from the track. One advantage of the magnetic restoring force is that dot placement errors are reduced. Another advantage is that the additional restoring force can be applied without moving the carriage rod's center of gravity.

According to another aspect of this invention, a magnet is mounted to the carriage in the vicinity of the antirotation roller. In addition a flux channel is included for establishing a magnetic flux path across a small gap toward the track surface near the antirotation roller. In an alternative embodiment the antirotation roller includes magnetic particles molded into the elastomeric compound forming a roller tire.

One advantage of this invention, is that print quality is improved. These and other aspects and advantages of the invention will be better understood by reference to the following detailed description taken in conjunction with the accompanying drawings.

BRIEF DESCRIPTION OF THE DRAWINGS

FIG. 1 is a diagram of inkjet printing dots of a first size having a given overlap;

FIG. 2 is a diagram of inkjet printing dots of a second size smaller than the first size and having a same percentage of overlap;

FIG. 4 is a block diagram of a carriage drive system;

FIG. 8 is a partial perspective view of the carriage V-bearings and magnetic preloader according to an embodiment of this invention; and FIG. 9 is an isometric view of the antirotation roller, magnetic restoring force apparatus and track surface according to an embodiment of this invention.

DESCRIPTION OF SPECIFIC EMBODIMENTS

Figure 3:
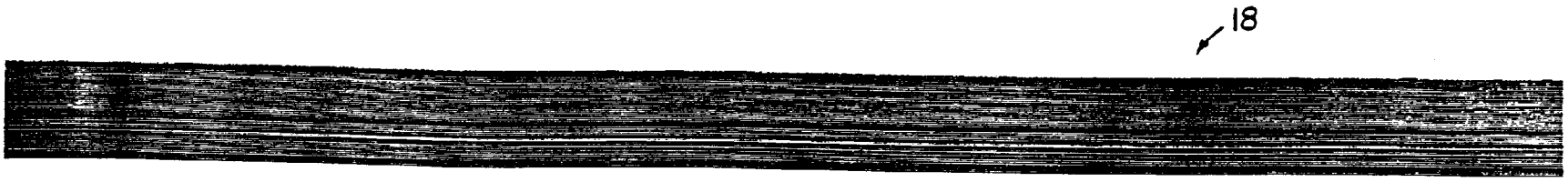
FIG. 3 is a copy of an image which exhibits banding due to vibrations of a carriage relative to a media sheet within an inkjet printing system.

FIG. 4 shows a carriage drive system 10 having a carriage 20 driven along a carriage path 22 under a drive force 24 generated by a drive motor 26. As the carriage is driven back and forth in directions 58–60, the carriage position along the carriage path 22 is monitored by a position detector 30, (e.g., linear encoder). The position detector 30 provides feedback of the carriage position for accurately controlling the movement of the carriage 20 relative to a media 32. The carriage carries a device 34 which acts upon the media 32.

In an inkjet printing apparatus embodiment, the device 34 is one or more inkjet pens. The inkjet pen includes a pen body with an internal reservoir and a printhead. The printhead includes an array of printing elements. For a thermal inkjet printhead, each printing element includes a nozzle chamber, a firing resistor and a nozzle opening. Ink flow from the reservoir into the nozzle chambers, then is heated by activation of the firing resistor. A vapor bubble forms in the nozzle chamber which forces an ink drop to be ejected through the nozzle opening not the media. Precise control of the ink drop ejection and the relative position of the inkjet pen and media enable formation of characters, symbols and images on the media.

In a document scanning apparatus embodiment the device 34 carried by the carriage 20 is one or more optical sensors and the media is a document having markings (e.g., characters, symbols or images). As the carriage moves relative to the document, the optical sensor detects the markings on the document. Precise control of the optical sensor position relative to the document enables an electronic image of the document to be generated. In character recognition systems, software is included which recognizes given marking patterns as given alphanumeric characters.

Figure 5:
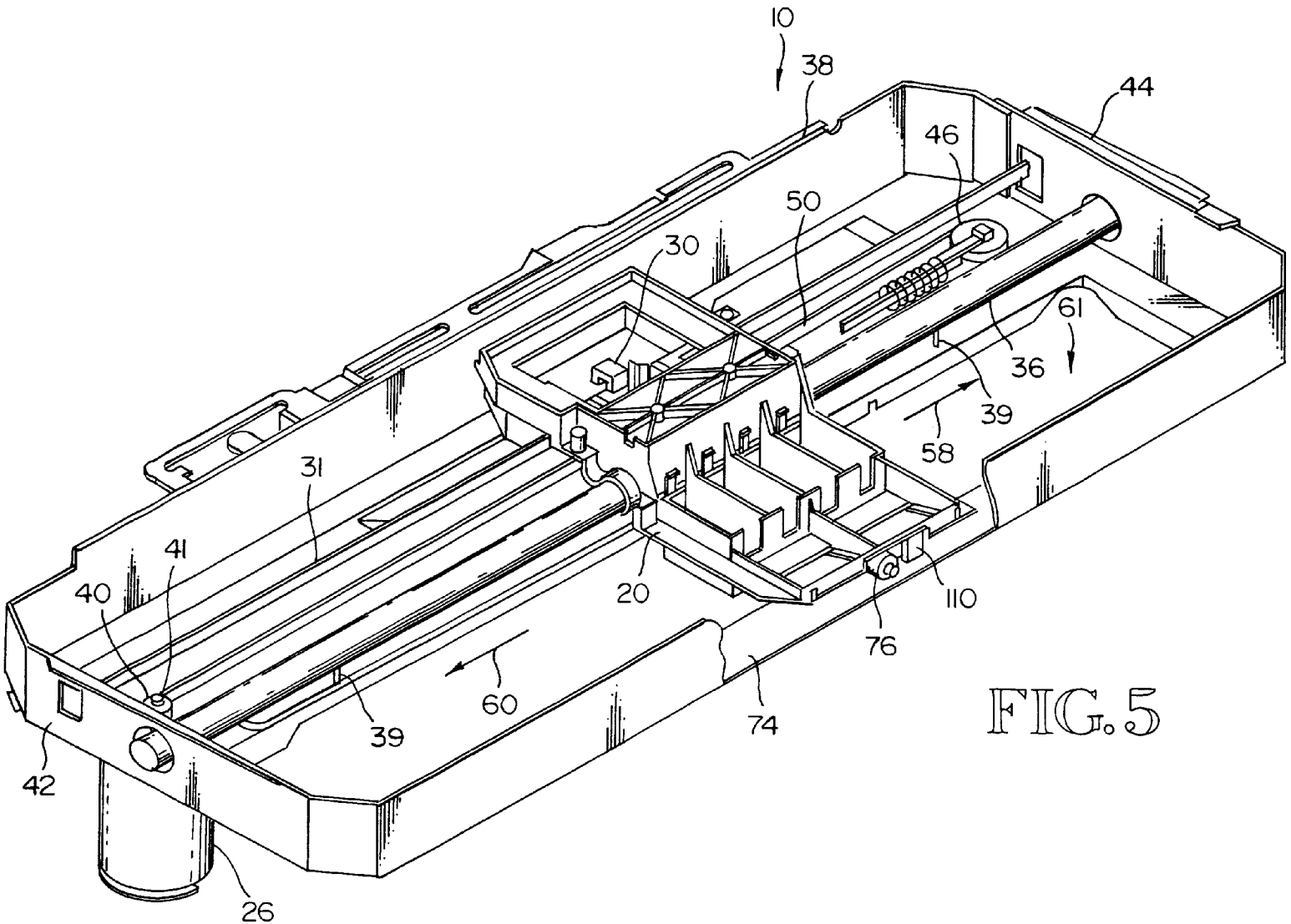
FIG. 5 is a perspective view of a carriage drive system for an inkjet printing system according to an embodiment of this invention.
Figure 6:
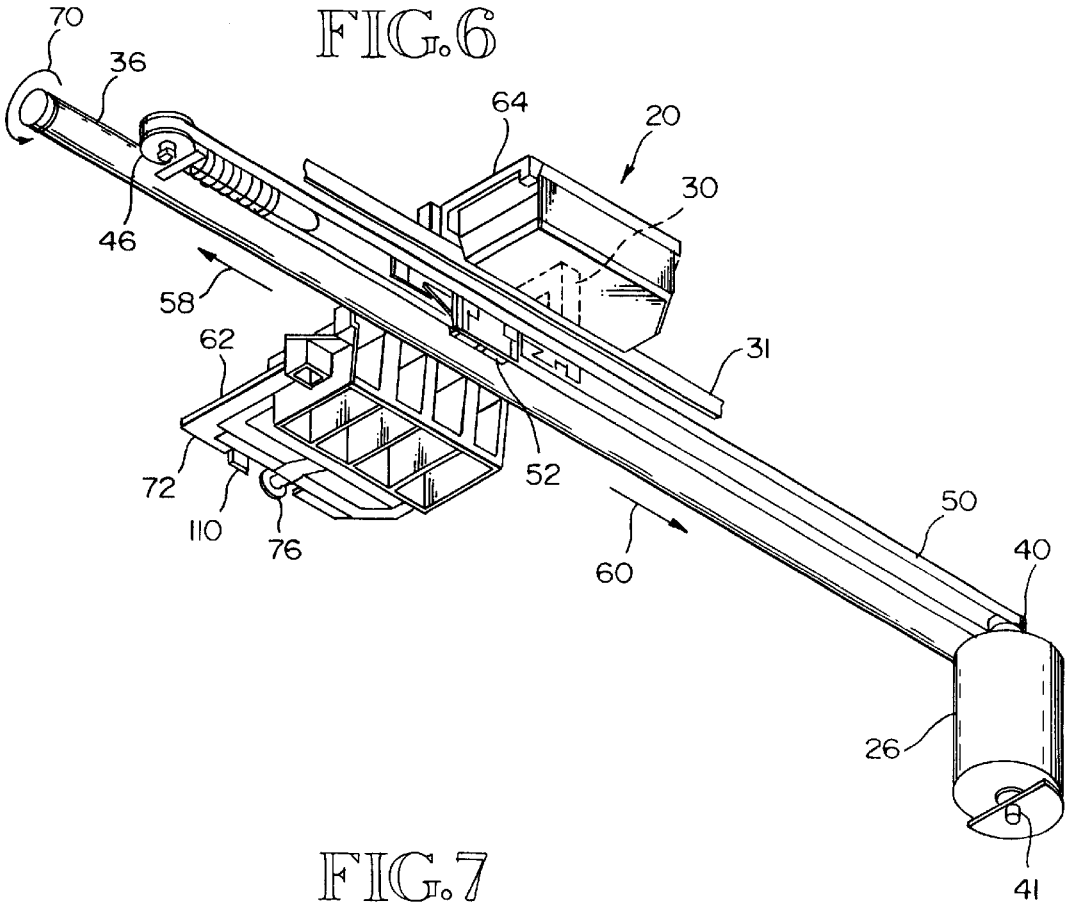
FIG. 6 is a perspective view of a portion of the carriage drive system of FIG. 5.

FIGS. 5 and 6 show a perspective view of the carriage drive system 10 according to an embodiment of this invention. The carriage 20 is driven along a carriage rod 36. The carriage rod is mounted to a carriage plate 38 at attachments 39. Preferably the attachments 39 connect the underside of the rod 36 to the plate 38, allowing the carriage to travel unimpeded along an upper surface of the rod 36. The ends of the carriage rod are mounted to the housing (not shown) of the printing or scanning system.

The carriage plate 38 serves as a frame for the carriage drive system 10. The drive motor 26 is mounted to the carriage plate 38. The drive motor 26 includes a rotating shaft 41 upon which a pulley 40 is mounted. The motor 26 and pulley 40 are located toward one end 42 of the drive plate. Toward an opposite end 44 a springloaded pulley 46 is mounted. A drive belt 50 runs along the pulleys 40, 46 and is held in tension by the spring-loaded pulley 46. The drive belt 50 is connected to the carriage 20 through a spring connection 52 so as to couple the drive force generated by the motor 26 to the carriage 20. As the motor 26 rotates its shaft, the drive belt runs along the pulleys 40, 46 causing the carriage to move first in one direction 58, then back in the opposite direction 60 along the carriage rod 36. The carriage plate 38 includes an opening 61 which exposes a portion of the carriage to an underlying media. Such carriage portion carries the device 34 (e.g., inkjet pen or document scanner sensor).

The carriage 20 carries a device 34 (see FIG. 4) for printing or scanning a media. The carriage 20 also carries a linear encoder module 30. A linear encoder strip 31 is fixed relative to the carriage plate 38. The strip 31 includes evenly spaced markings. The linear encoder module 30 includes an optical sensor which detects and counts such markings so as to track the location of the carriage 20 relative to the strip 31.Because the strip 31 and carriage rod 36 are fixed relative to the carriage plate 38, the linear encoder module 30 is able to detect the carriage position relative to the linear encoder strip 31, the carriage plate 38 and the carriage rod 36.

Figure 7:
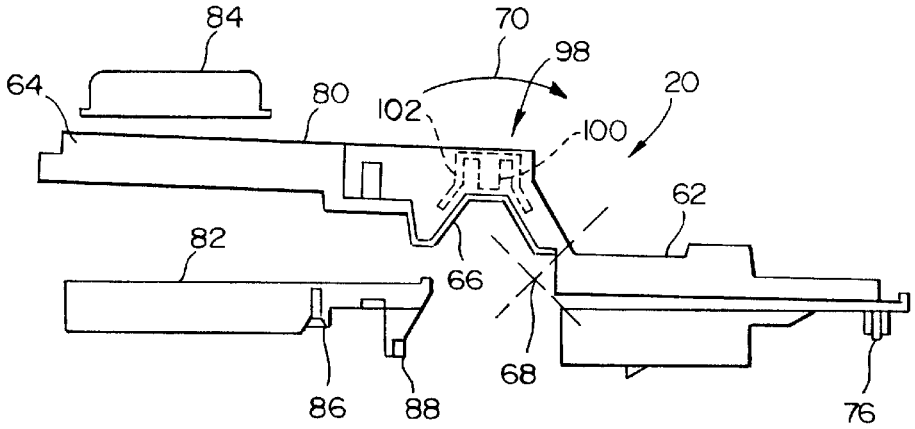
FIG. 7 is an exploded planar view of the carriage of FIGS. 5 and 6.

FIG. 7 shows an exploded view of the carriage 20 for an inkjet printing embodiment. The carriage is formed by a first member 80, a second member 82 and a cap member 84. The second member 82 and cap member 84 are attached to the first member 80. The first member 80 includes a first portion 62 for carrying an inkjet pen device 34 (see FIG. 1) and a second portion 64 for receiving the second member 82 and cap member 84. The second member 82 houses the linear encoder module and other electronic circuitry (e.g., print control circuitry, print memory). The second member 82 includes a slot 86 through which the linear encoder strip 31 runs during movement of the carriage 20. The second member 82 also includes the spring connection 88 which couples the carriage 20 to the drive belt 50. The cap member 84 covers the linear encoder module 30 and electronic circuitry.

The first member 80 includes a V-bearings 66 (see FIGS. 7 and 8) located laterally at each side of the carriage 20 along the direction of the rod 36 (see FIG. 5). The V-bearings 66 are a plastic V-shaped portion of the carriage 20 at which contact is made between the carriage 20 and the carriage rod 36. Specifically, the carriage rests on the carriage rod 36 at the V-bearings 66 and may be lifted from the rod 36. The carriage 36 is preloaded by a magnetic circuit 98 to maintain contact with the carriage rod 36. The magnetic circuit 98 includes a permanent magnet 100 and a flux channel 102. The magnet 100, flux channel 102, and carriage rod 36 are formed of a ferromagnetic material. A flux path is formed from the magnet across a gap 104 to the rod, then back across another gap to 106 the flux channel 102 and back to the magnet 100. Alternatively, the flux path is in the reverse direction going from the magnet 100 to the flux channel 102 across a gap 106 into the rod 36 and back across another gap 104 to the magnet 100. The effect is a magnetic force which preloads the carriage 20 into contact with the carriage rod 36 at the V-bearings 66.

Preferably the magnetic circuit 98 is located to the same side of the rod 36 as the V-bearings 66. This allows the rod 36 to be mounted at its underside to the plate 38 at attachments 39. A magnetic preloading force is preferred to a spring biased force to avoid contact between the source of the preloading force and the rod. As a result, less friction occurs with a magnetic preloader than with a spring biased contact preloader. The difference in friction lowers the load on the carriage drive motor 26 and allows a higher preloading force to be used for a given motor 26. In addition, the angle of the preloading force is more easily positioned at an optimum angle relative to the V-bearings. Further the magnetic preloader can be smaller than a system which uses a spring, and thus more easily positioned within the carriage area. Another advantage of the magnetic preloader circuit 98 is that the shape of the flux channel 102 is selected to achieve multiple preloading force vectors between the rod 36 and carriage 20 using a single magnet.

With the pen(s) loaded and the electronic circuitry mounted, the center of gravity 68 of the carriage 20 is located slightly forward and down of the opening 66 center point toward the first portion 62. Thus, as the carriage 20 moves along the carriage rod 36 there is a moment arm 70 (see FIG. 6) about the carriage rod 36 which biases a distal end 72 of the carriage 20 toward a first surface 74 of the carriage plate 38. A roller 76 is mounted to the carriage 20 first portion 62 toward the distal end 72. Under the gravitational force of the moment arm 70, the roller 76 resides in contact with the carriage plate first surface 74. As the carriage 20 moves along the carriage rod 36, the roller 76 runs along the first surface 74. The first surface 74 is in effect a track for the roller 76. Referring to FIG. 5, a portion of the carriage plate 38 is shown in cut-away view to reveal the roller 76 and first surface 74. In an alternative embodiment the roller 76 is a sled or ski.

The moment arm 70 biases the distal end 72 of the carriage 20 toward the first surface 74 of the carriage plate 38. Referring to FIGS. 5, 6 and 9 there is a roller 76 mounted to the carriage 20 first portion 62 toward the distal end 72. Under the gravitational force of the moment arm 70, the roller 76 resides in contact with the carriage plate first surface 74. As the carriage 20 moves along the carriage rod 36, the roller 76 runs along the first surface 74. The periphery of the roller 76 serves as a running surface 77 (see FIG. 9) which moves along the track surface 74. During such relative movement, vibrations may be introduced to the system through the roller 76 or track surface 74. The roller 76 introduces vibrations, for example, if it is not precisely round (e.g., bumps or flat spots along the periphery of the roller). The roller also introduces vibrations when the axle is not precisely centered. In addition, the track introduces vibrations by not being smooth. As the roller moves along the track, bumps in the track cause vibrations. In an alternative embodiment the roller 76 is replaced by a sled or ski. The roller, sled or ski make contact with the carriage plate first surface 74. In some embodiments a vibration isolator is included as a suspension for the roller 76 or the sled or ski.

To further reduce the affects of vibrations on the carriage due to the motion of the roller 76 a restoring force is applied in the vicinity of the roller to bias the carriage rotation into the track surface 74. At high slew velocities of the carriage 20, a local discontinuity, such as a bump, encountered by the roller 76 causes an acceleration of the roller 76 away from the track surface 74. The magnitude of the acceleration is proportional to the effective slope of the discontinuity multiplied by the carriage slew velocity. The effective slope is the slope of the discontinuity on the roller's surface The upward rotation causes a torque rotating the carriage 20 around the carriage rod 36 in the direction 70. Such torque is proportional to the moment of inertia times the acceleration at the roller. Gravity causes a restoring torque opposing this rotational torque. The gravitational restoring force is proportional to gravity times the distance from the carriage center of gravity 68 to the carriage rod 36.

An additional restoring torque is applied at the roller 76 to keep the roller running smoothly along the track surface. In a preferred embodiment the restoring force is provided by a magnetic circuit 110. When a bump is encountered, upward displacement at the roller 76 depends on the acceleration (e.g. the effective slope at the bump), the duration of the acceleration (e.g., the height of the bump), the rotational inertia of the carriage 20, the restoring force attributable to gravity, and any additional restoring forces. According to a preferred embodiment a magnetic restoring force is applied minimizing the upward rotation of the roller from the track. One advantage of the magnetic restoring force is that dot placement errors are reduced. Another advantage is that the additional restoring force can be applied without moving the carriage rod's center of gravity.

Referring to FIG. 9, the magnetic circuit 110 includes a permanent magnet 112, a flux channel 114 and a lubricated plastic bearing 116. The magnet 112 and flux channel 114 are formed from a ferromagnetic material. The magnet 112 is mounted to the carriage 20 in the vicinity of the antirotation roller 76. The flux channel 114 establishes a magnetic flux path toward the track surface 74 near the antirotation roller 76. In a specific embodiment the plastic bearing 116 separates the flux channel 114 and the magnet 112 from the track surface. The magnet generates a magnetic flux circuit which goes from the magnet 112 through the plastic bearing 116 into the track surface 74, then back through the plastic bearing 116 into the flux channel 114, then to the magnet 112. (Alternatively the flux path travels in the opposite direction from the magnet 112 to the flux channel 114 then across the plastic bearing 116 to the track surface 74, then back through the plastic bearing 116 into the magnet 112. One advantage of the flux channel 114 is that multiple magnetic force vectors are achieved between the magnetic circuit 110 and the track surface 74.

In an alternative embodiment an air gap occurs between the magnet 112 and the track surface 74 and between the flux channel 114 and the track surface 74. In such embodiment the plastic bearing is still present and makes contact with the track surface defining the air gap distance between magnet 112/flux channel 114 and the track surface 74.

Even where a soft tire is used for roller 76, the magnetic restoring force still is effective to reduce deflections of the roller 76 from the track surface 74. The system dynamics, however, are more complex. A roller 76 which is soft will absorb small bumps. The spring rate of the roller 76 and the rotational inertia of the carriage from a resonant system with low damping can have the undesirable effect of oscillating if the input energy spike occurs nears the resonant frequency of the system. The presence of the magnetic circuit 110, however, increases the natural frequency of the system and reduces the deflection due to such energy spike disturbances.

In an alternative embodiment the magnetic circuit is formed within the roller 76. Specifically, magnetic particles are molded into the elastomeric compound forming the roller 76.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A carriage drive system, comprising:

a carriage rod;

a carriage which moves along the carriage rod;

a drive motor for moving the carriage along the carriage rod;

a running surface mechanically coupled to the carriage and moving with the carriage, the running surface not contacting the carriage rod;

a track surface not part of the carriage rod, wherein the running surface moves along the track surface as the carriage moves along the carriage rod, wherein a local discontinuity in physical communication between the running surface and the track surface during movement of the running surface along the track surface causes an acceleration of the running surface away from the track surface; and a magnetic restoring force source which biases the carriage toward the track surface to reduce the acceleration of the running surface away from the track surface.

2. The system of claim 1, in which the magnet reduces rotational vibration of the carriage relative to the carriage rod during movement of the running surface along the track surface.

3. The system of claim 1, in which the magnetic restoring force source comprises a magnet and a flux channel mounted to the carriage, the magnet and flux channel being spaced from the track surface.

4. The system of claim 1, in which the running surface is a peripheral surface of a roller, and in which the magnetic restoring force source comprises magnetic particles embedded within the roller.

5. The system of claim 1, in which the carriage rests on the carriage rod and is preloaded into contact with the carriage rod by a magnetic force.

6. The system of claim 5, in which the carriage comprises a plastic bearing which is in contact with the carriage rod without wrapping around an entire circumference of the carriage rod.

7. The system of claim 5, further comprising a magnetic circuit which generates the magnetic force which preloads the carriage into contact with the carriage rod.

8. A carriage drive system, comprising:

a carriage rod;

a carriage which moves along the carriage rod; and a drive motor for moving the carriage along the carriage rod;

wherein the carriage rests on the carriage rod and is preloaded into contact with the carriage rod by a magnetic force, the carriage comprising a plastic bearing, the carriage resting on the carriage rod at said bearing, the bearing being in contact with the carriage rod without wrapping around an entire circumference of the carriage rod.

9. The system of claim 8, further comprising:

a running surface mechanically coupled to the carriage and moving with the carriage;

a track surface, wherein the running surface moves along the track surface as the carriage moves along the carriage rod, wherein a local discontinuity between the running surface and the track surface causes an acceleration of the running surface away from the track surface; and a magnetic restoring force source which biases the carriage toward the track surface to reduce the acceleration of the running surface away from the track surface.

10. The system of claim 9, in which the magnetic restoring force reduces rotational vibration of the carriage relative to the carriage rod during movement of the running surface along the track surface.

11. The system of claim 9, in which the magnetic restoring force source comprises a magnet and a flux channel mounted to the carriage, the magnet and flux channel being spaced from the track surface.

12. The system of claim 9, in which the running surface is a peripheral surface of a roller, and in which the magnetic restoring force source comprises magnetic particles embedded within the roller.

13. A method for reducing rotational displacement of a carriage about a carriage rod during motion of the carriage longitudinally along the carriage rod, the method comprising the steps of:

moving the carriage along the carriage rod, during which a running surface, mechanically coupled to the carriage and moving with the carriage, moves along a track surface;

during the step of moving, encountering a local discontinuity in contact between the running surface and the track surface which cause an acceleration of the running surface away from the track surface, the acceleration inducing a rotational torque of the carriage about the carriage rod;

applying a magnetic restoring force source which biases the carriage toward the track surface to reduce said acceleration and said rotational torque.

14. The method of claim 13, in which the step of applying comprises the step of directing the magnetic restoring force along a flux channel which achieves multiple magnetic force vectors with the track surface.

15. The method of claim 13, in which the carriage rests on the carriage rod and further comprising the step of:

preloading the carriage into contact with the carriage rod with a magnetic force.

16. A method for moving a carriage along a carriage rod, comprising the steps of:

positioning the carriage to rest on the carriage rod at carriage bearings, the carriage bearings not wrapping around an entire circumference of the carriage rod;

preloading the carriage into contact with the carriage rod with a magnetic force; and moving the carriage along the carriage rod.

17. The method of claim 16 in which the carriage and carriage rod are part of a carriage drive system which further includes a running surface mechanically coupled to the carriage and moving with the carriage, and a track surface, the method further comprising the steps of:

during the step of moving, encountering a local discontinuity between the running surface and the track surface which cause an acceleration of the running surface away from the track surface, the acceleration inducing a rotational torque of the carriage about the carriage rod; and applying a magnetic restoring force source which biases the carriage toward the track surface to reduce said acceleration and said rotational torque.

18. The method of claim 17, in which the step of applying comprises the step of directing the magnetic restoring force along a flux channel which achieves multiple magnetic force vectors with the track surface.

* * * * *